US008863633B2

(12) United States Patent
Gotie

(10) Patent No.: US 8,863,633 B2
(45) Date of Patent: Oct. 21, 2014

(54) JAM RESISTANT AMMUNITION MAGAZINE

(75) Inventor: Robert Christian Gotie, Scottsdale, AZ (US)

(73) Assignee: Dillon Aero Inc., Scottsdale, AZ (US)

( * ) Notice: Subject to any disclaimer, the term of this patent is extended or adjusted under 35 U.S.C. 154(b) by 196 days.

(21) Appl. No.: 13/525,064

(22) Filed: Jun. 15, 2012

(65) Prior Publication Data

US 2012/0318128 A1 Dec. 20, 2012

Related U.S. Application Data

(60) Provisional application No. 61/497,279, filed on Jun. 15, 2011.

(51) Int. Cl.
*F41A 9/00* (2006.01)

(52) U.S. Cl.
USPC ..... 89/33.14; 89/34

(58) Field of Classification Search
USPC ..... 42/49.01, 50; 89/33.01, 33.14, 33.16, 89/33.2, 34; 206/3
See application file for complete search history.

(56) References Cited

U.S. PATENT DOCUMENTS 661,201 A * 11/1900 Wilding ..... 89/34
1,719,126 A * 7/1929 Pfeiffer et al. ..... 89/33.14
1,800,595 A * 4/1931 Browning ..... 89/33.14
2,401,762 A * 6/1946 Irasek ..... 89/34
3,580,131 A * 5/1971 Zimmerman ..... 89/34
4,009,638 A 3/1977 Ramseyer et al.
4,259,891 A 4/1981 Rosenzweig
4,389,918 A * 6/1983 Peck ..... 89/34
4,393,746 A 7/1983 Rocha
4,433,609 A 2/1984 Darnall
4,610,191 A 9/1986 Schmid et al.
4,681,019 A * 7/1987 Brandl et al. ..... 89/33.04
4,972,758 A 11/1990 Austin et al.
4,974,490 A 12/1990 Austin
5,245,908 A 9/1993 Sanderson
6,164,180 A 12/2000 Sulm et al.
6,439,098 B1 8/2002 Dillon
6,799,500 B1 10/2004 Kulikowski
7,546,794 B1 6/2009 Sarles et al.
7,913,610 B2 3/2011 Ulveraker et al.
7,918,153 B1 4/2011 Gordon et al.

FOREIGN PATENT DOCUMENTS

DE 102005007786 A1 * 11/2006 ..... F41A 9/56

* cited by examiner

*Primary Examiner* — Gabriel Klein
(74) *Attorney, Agent, or Firm* — James L Farmer

(57) ABSTRACT

Methods and apparatus are provided for a passive locking device for preventing an ammunition belt from sliding across the top of an internal wall of an ammunition magazine used in conjunction with a belt feed weapon. In one embodiment the passive locking device is movable between a locked position in which a locking end is in close proximity to the top of the internal wall, and an unlocked position in which the locking end is spaced apart from the top of the wall.

9 Claims, 11 Drawing Sheets

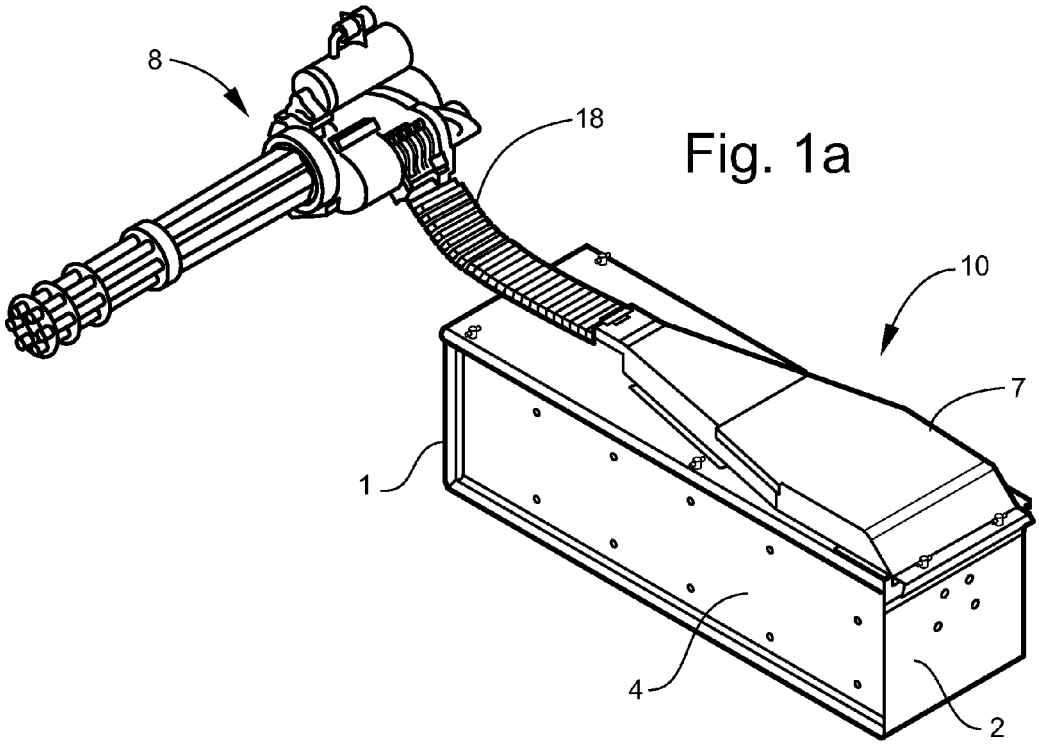
Fig. 1a
Fig. 2
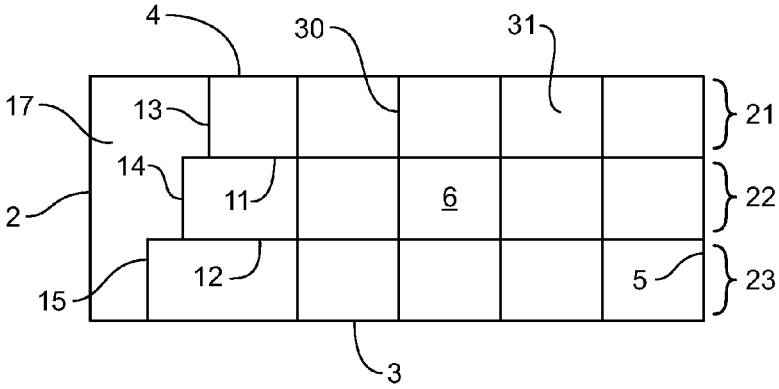

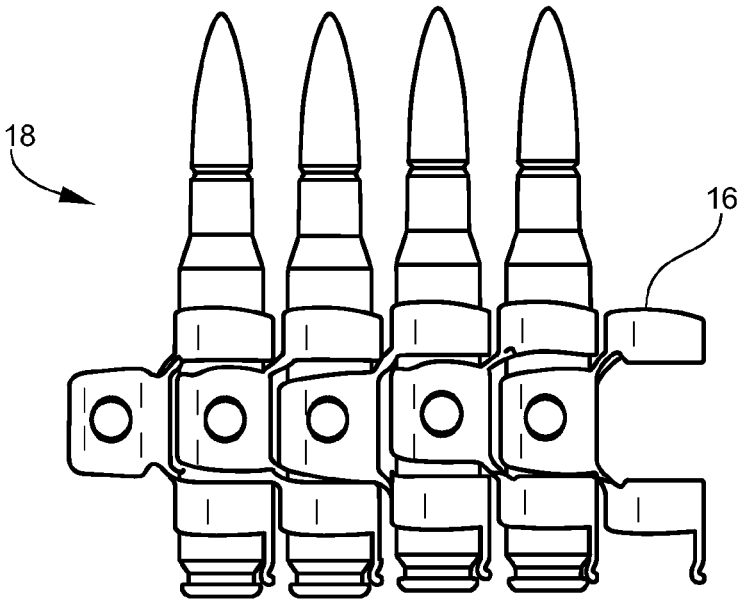
Fig. 1b
Fig. 1c
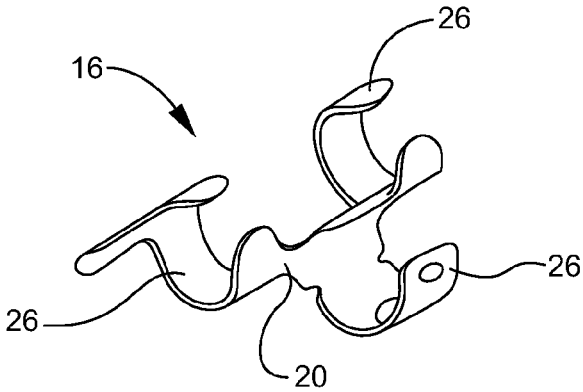

JAM RESISTANT AMMUNITION MAGAZINE

This application claims the benefit of U.S. Provisional Application No. 61/497,279, filed Jun. 15, 2011, the entire contents of which are hereby incorporated by reference.

TECHNICAL FIELD

The present invention generally relates to ammunition magazines used in conjunction with belt feed weapons.

BRIEF DESCRIPTION OF THE DRAWINGS

In the accompanying drawings:

FIG. 1*a* is a perspective view of an exemplary ammunition magazine feeding an electric gatling gun;

FIGS. 1*b* and 1*c* depict elements of an exemplary ammunition belt for use in conjunction with the ammunition magazine of the present disclosure;

FIG. 2 is a simplified top view of the box portion of the ammunition magazine of FIG. 1;

DESCRIPTION OF THE EMBODIMENTS

Figure 3:
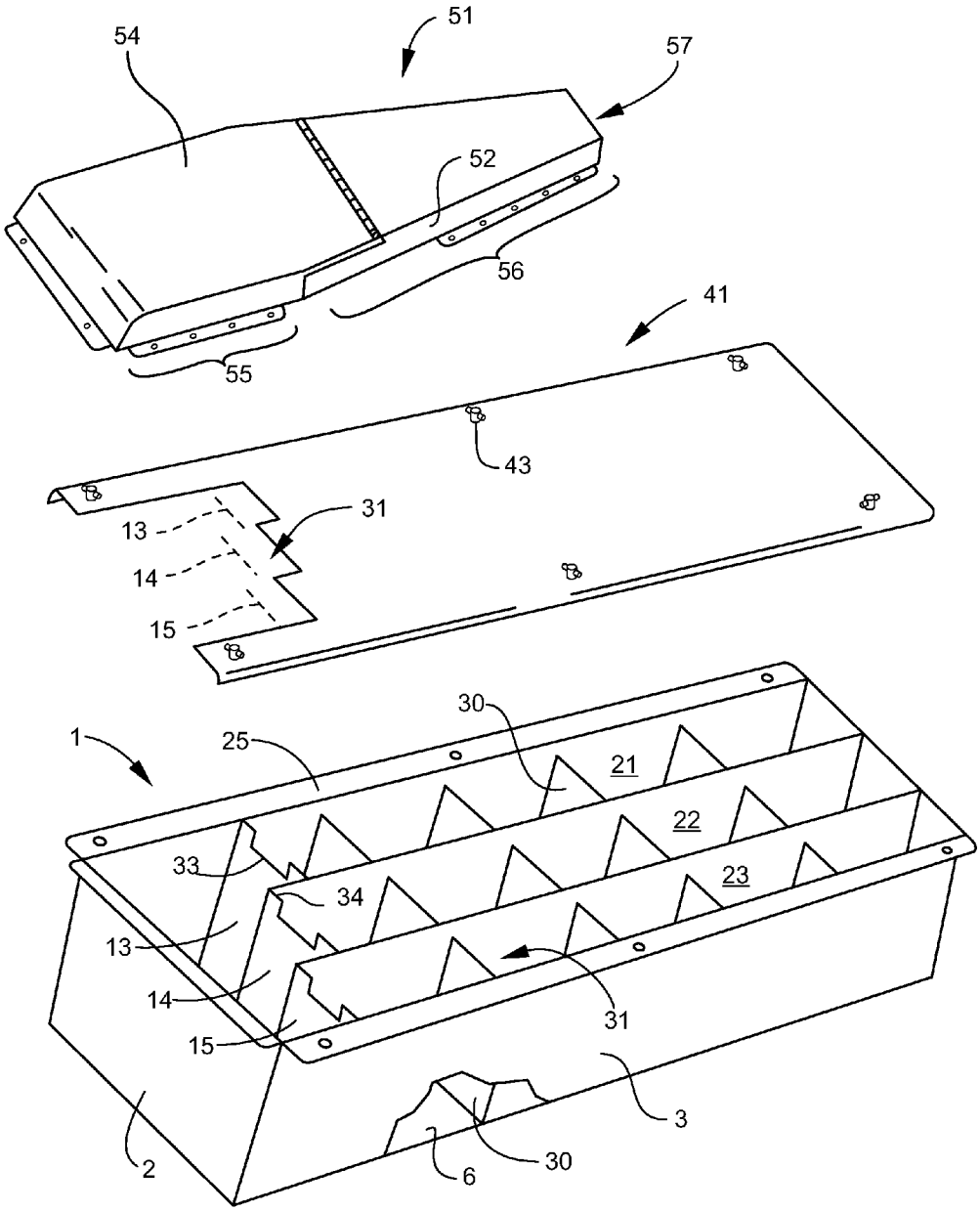
FIG. 3 is an exploded perspective view of an exemplary ammunition magazine.
Figure 4:
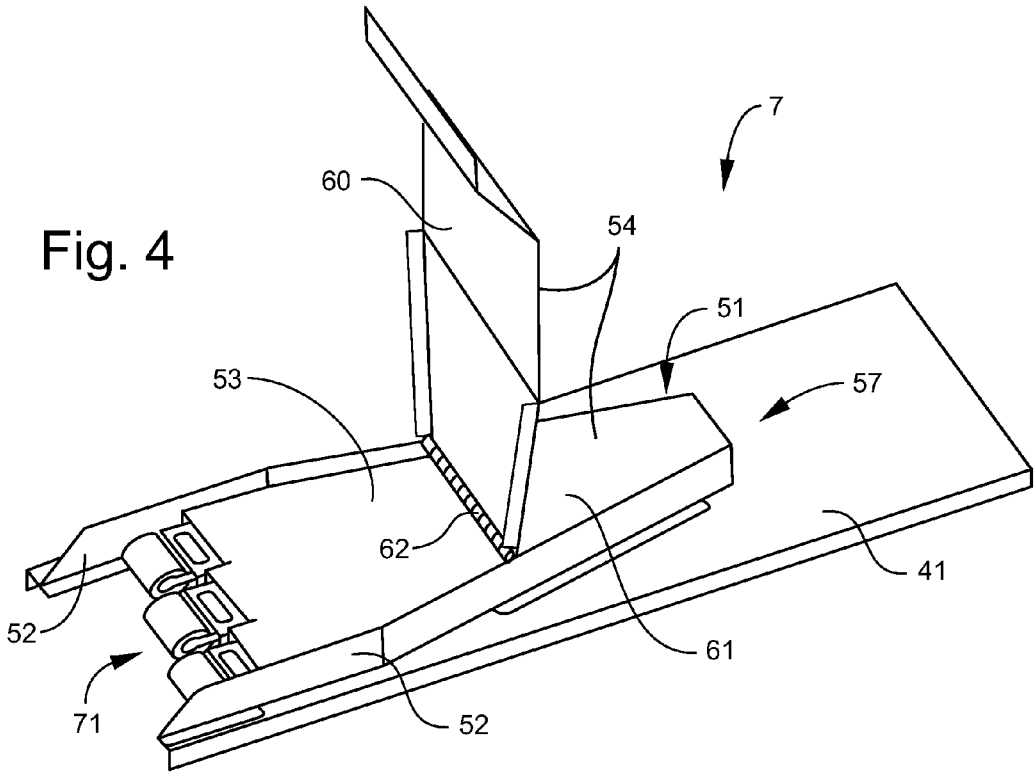
FIG. 4 is a perspective view of the top of the ammunition magazine.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Terms such as "connected" or "attached" as used herein are intended to denote direct, indirect (with intermediate elements), rigid, and flexible linking arrangements, as well as linking arrangements with one or more degrees of freedom.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawing figures, an exemplary ammunition magazine in accordance with the present invention is disclosed, and indicated generally at reference numeral 10. Magazine 10 may be used in conjunction with a belt feed weapon, such as for example the gatling gun 8 illustrated in FIG. 1*a*, for holding and dispensing an ammunition belt 18. Ammunition belts for belt feed weapons may comprise thousands of rounds linked together in a side-by-side, hinged manner. The belts may take various forms, such as a flexible strap, or a hinged linkage. For example, the US Military's six-barrel M134 electric gatling gun uses 7.2×51 mm NATO ammunition in what is known as a disintegrating link belt. An exemplary disintegrating link belt 18 is depicted in FIGS. 1*b* and 1*c*. The disintegrating link belt comprises separate metal links in the form of clips 16 that simply snap over the casings of two adjacent ammunition rounds. The bullet casings are free to pivot inside the barrel portions 26 of clip 16, creating a hinged joint at each connection. When the gun is being fired, a built in de-linker removes and discharges the clips 16 one at a time as each round enters the gun.

As best seen in FIGS. 2 and 3, an exemplary magazine 10 of the present disclosure may comprise an elongated box 1 with a front wall 2, a right side wall 3, a left side wall 4, a back wall 5, a bottom 6, and a top 7. In simplest form the box itself thus forms a single ammunition compartment. Alternatively, the box may include one or more longitudinal partitions dividing the box into multiple parallel ammunition compartments. In the depicted embodiment, two longitudinal partitions 11, 12, divide the box into three side-by-side compartments 21, 22, 23 extending from the back wall 5 at one end, to crossover walls 13, 14, and 15 respectively at the other ends. The crossover walls 13-15 may be arranged in a staggered pattern, with wall 15 the closest to front wall 2 of box 1, and wall 13 the farthest from the front wall. Alternatively, the outer crossover walls 13 and 15 may each have a bottom portion that aligns with center crossover wall 14, and upper portions that are staggered front and back of center wall 14.

A series of baffles 30 separate each of the compartments 21, 22, 23 into a plurality of ammunition storage bays 31 that are generally evenly disposed between back wall 5 at one end, and the crossover walls 13, 14, 15 at the other ends of the compartments. In the front portion of box 1 the front wall 2, side walls 3, 4, and crossover walls 13-15 define a crossover bay 17 that extends the full width of the box. The baffles 30 and crossover walls 13-15 may be shorter than the walls of the box by at least the thickness of the ammunition belt 18, while the partitions 11, 12 may be even with the walls 3-5 of the box. The box 1 including all of the above described partitions, baffles, and crossover walls, may be a unitary structure fabricated from any suitable structural material or combinations of materials, including for example sheet metal, various plastics, fiberglass, and other composites.

Referring specifically to FIGS. 3 through 6, the top 7 comprises a lid 41, and a feeder chute 51 atop the lid 41. The lid 41 is essentially a flat plate designed to sit securely atop box 1, and may be adapted with fasteners, such as the quarter turn fasteners 43 shown for locking the lid down against flange 25 of box 1. As best seen in FIG. 3, the front portion of lid 41 is cut out such that the crossover bay 17 and a portion of each of the forward most storage bays 31 are not covered by the lid. The position of crossover walls 13-15 are indicated with dashed lines in FIG. 3 to illustrate the partial exposure of the forward most storage bays 31. The lid 41 is supported by the box walls and the partitions 11, 12 above the shorter crossover walls 13-15 and baffles 30, creating gaps 45 and 46 therebetween (see FIG. 5).

An exemplary feeder chute 51 comprises side walls 52, a chute floor 53, a chute top 54, and passive ammunition locks 71. The chute top 54 comprises a hinged portion 60 connected to a fixed portion 61 via hinge 62. The side walls 52 are parallel and spaced apart approximately the width of box 1 in the front, straight portion 55 of feeder chute 51. Rearward of straight portion 55 the sidewalls 52 converge towards each other in a tapered portion 56 extending to an exit opening 57. The chute floor 53 and chute top 54 along with side walls 52 define an ammunition discharge passage 58 through which the ammunition belt 18 slides as it is pulled from the magazine.

Figure 5:
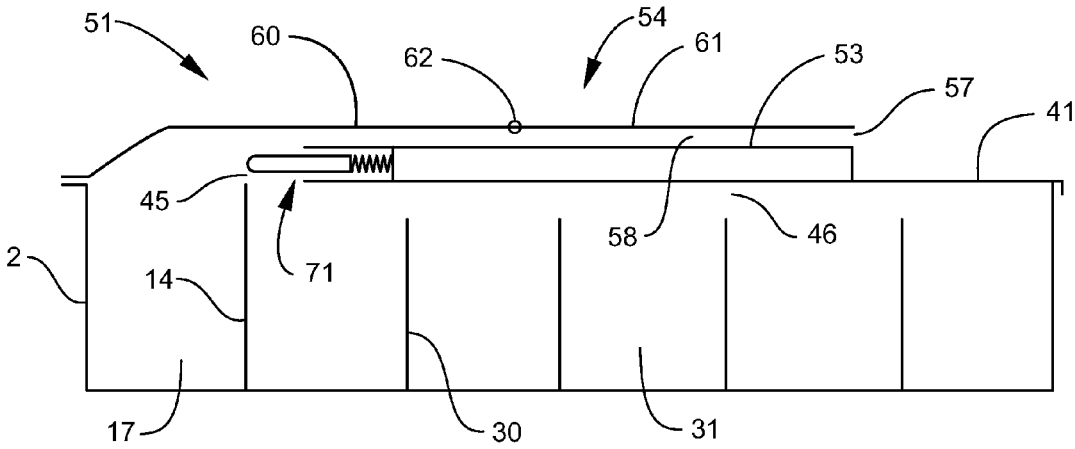
FIG. 5 is a cross section through a middle longitudinal compartment of an exemplary ammunition magazine.
Figure 6:
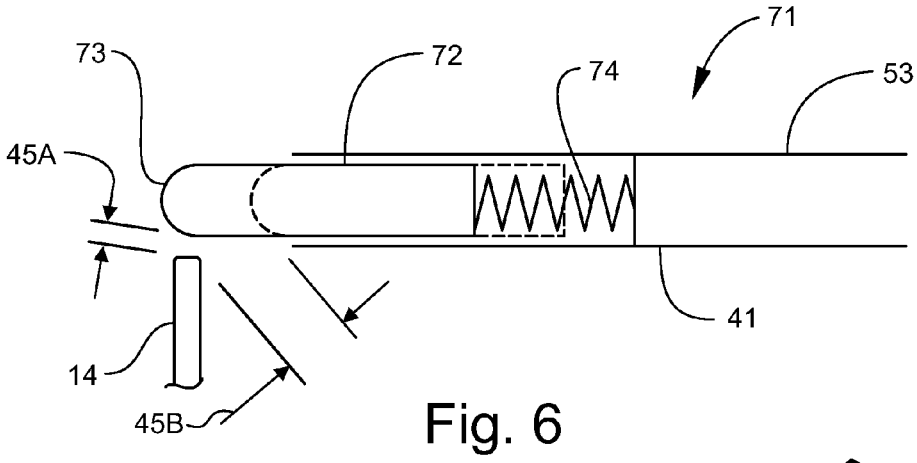
FIG. 6 is a schematic side section of an ammunition lock shown in locked and unlocked positions relative to a crossover wall.

Referring to FIGS. 5 and 6, a passive ammunition lock 71 is disposed between the chute floor 53 of feeder chute 51 and the lid 41 of box top 7 proximate the forward ends of each of compartments 21-23. Each lock 71 comprises a locking member movable between locked and unlocked positions. In the present embodiment the locking member is a guided slide member 72 with a locking end 73, and a spring 74. The slide member 72 is movable between a locked position shown in solid lines in FIG. 6, and an unlocked position shown in dashed lines. The spring 74 is adapted to bias the guided slide member 72 forward to the locked position, wherein a narrow gap 45A is defined between the locking end 73 of slide member 72 and a locking surface such as the crossover wall 14. In the forward, locked position the width of gap 45A is less than the thickness of the ammunition belt 18.

From the locked position the slide member 72 can be moved to the unlocked position by application of a rearward force against the locking end 73, wherein a wide gap 45B is defined between the locking end 73 and the crossover wall 14. In the unlocked position the width of gap 45B is greater than the thickness of ammunition belt 18. The force required to compress spring 74 and move slide member 72 into the unlocked position may be provided entirely by the ammunition belt as the belt is pulled from the magazine. Absent a rearward force such as that provided by the belt, the forward bias of spring 74 returns the slide member 72 to the forward locked position.

Figure 7:
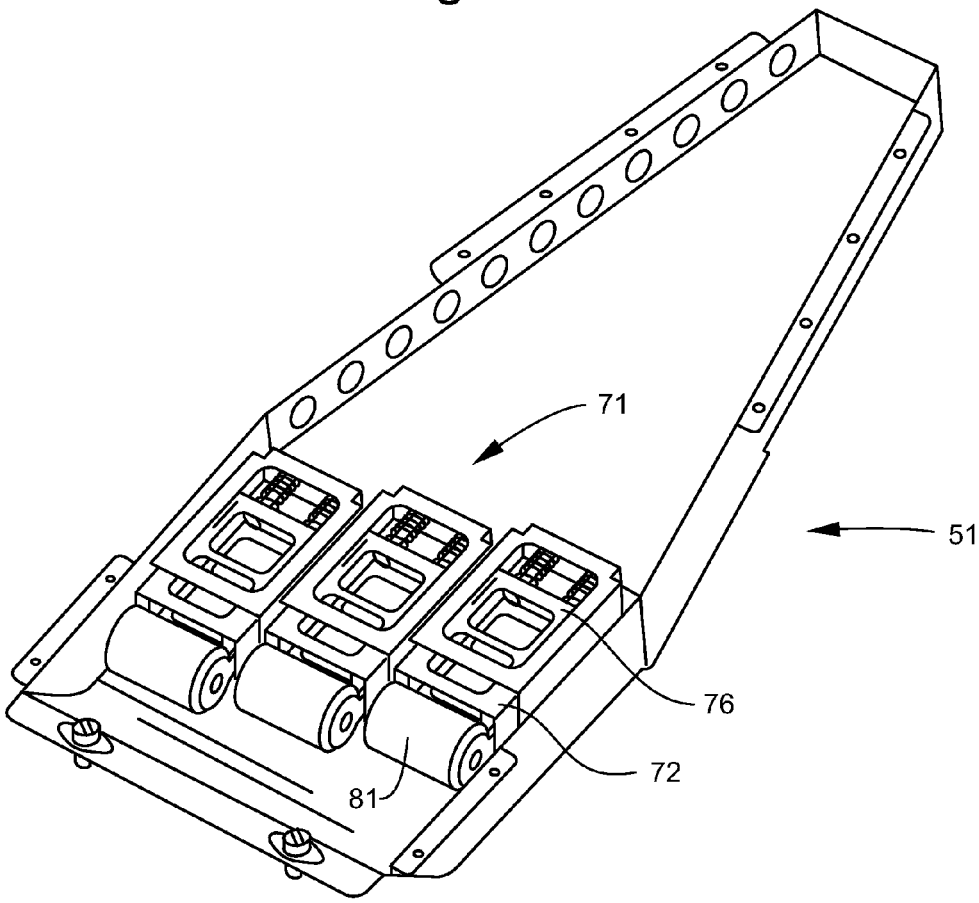
FIG. 7 is a bottom perspective view of a feeder chute portion of the ammunition magazine including three ammunition locks.
Figure 8:
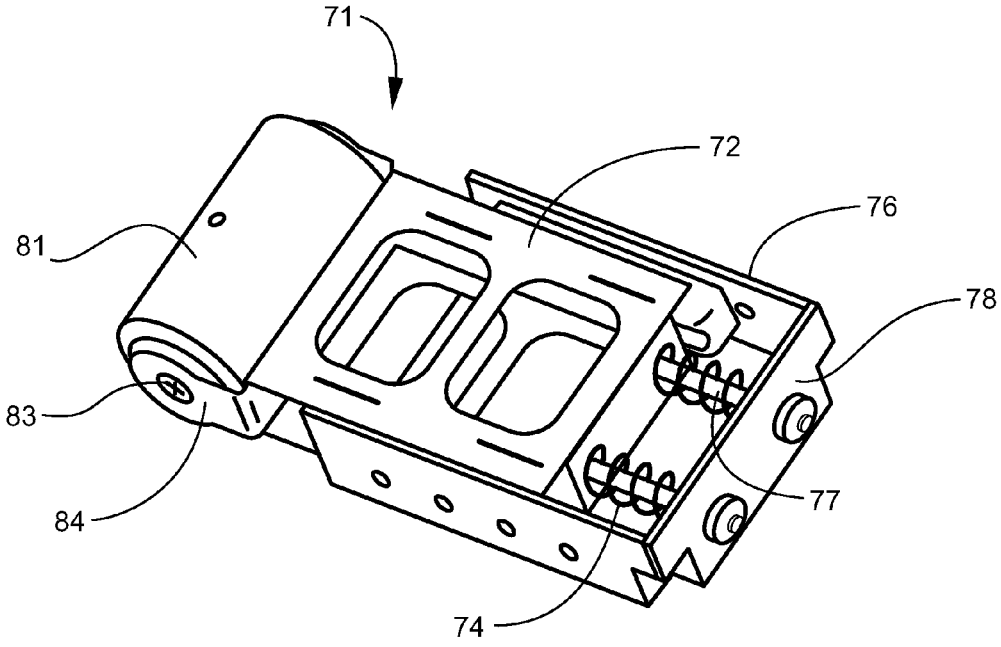
FIG. 8 is a perspective view of one of the ammunition locks shown in FIG. 7.

Another embodiment of the spring loaded ammunition lock 71 is shown in FIGS. 7 and 8. FIG. 7 is a bottom perspective of an exemplary feeder chute 51 with three ammunition locks 71. As can be seen, the locks 71 are in a staggered arrangement reflecting the staggered positions of the respective crossover walls 13-15 in box 1. Each of ammunition locks 71 comprises a slide member 72 disposed for sliding longitudinal movement in a channel 76 fixed between the chute floor 53 and the lid 41. A pair of springs 74 disposed about forward extension limit rods 77 bias the slide member 72 forward toward the extended, locked position. A back flange 78 of fixed channel 76 serves as a support for springs 74 and extension limit rods 77.

As best seen in FIG. 8, the locking end of the slide member 72 of the present embodiment comprises a locking roller 81. The roller 81 is a cylinder approximately the width of the ammunition belt 18, and may be anywhere between one to six times the thickness of ammunition belt 18 in diameter. The roller 81 may be made of any relatively rigid material, such as various metals or plastics. The roller 81 is journaled for rotation about an axel 83 mounted in a bracket portion 84 of slide member 72. As will be described in greater detail below, the roller 81 is configured such that the gap between the roller and a respective locking surface such as crossover wall 13-15 is less than the thickness of the ammunition belt when slide member 72 is in the forward, locked position, and greater than the thickness of the ammunition belt when in the rearward, unlocked position.

FIGS. 9-12 depict a method of loading ammunition belt 18 into box 1. Beginning with FIG. 9, ammunition belt 18 is positioned in the bottom 6 of box 1 with a first end 19 of the belt proximate the back of crossover wall 13 in compartment 21. Belt 18 is then draped up and over the baffle 30 immediately behind crossover wall 13, and down to the floor of the next storage bay 31. The same process is repeated across the remaining baffles and bays until the ammunition belt reaches the back wall 5 of box 1.

Figure 9:
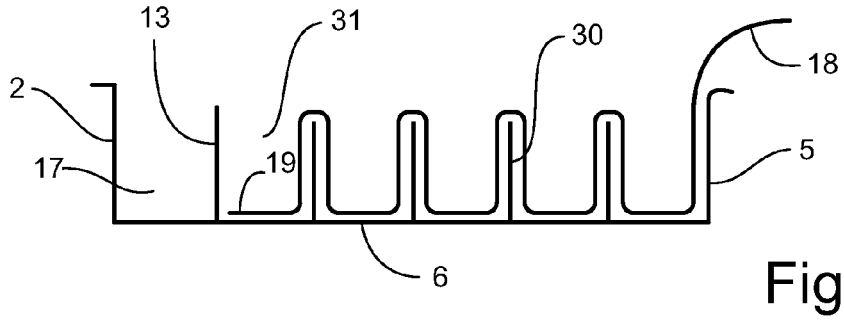
FIGS. 9-11 depict an exemplary sequence for loading an ammunition belt into a first longitudinal compartment of the ammunition magazine.
Figure 10:
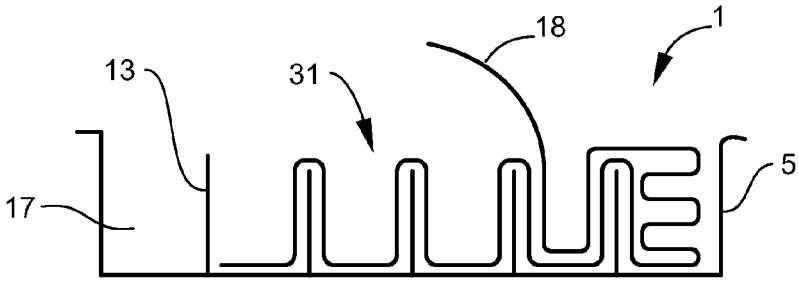
Figure 11:
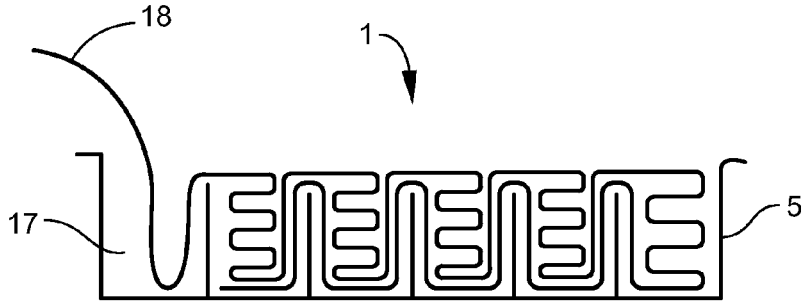
Figure 12:
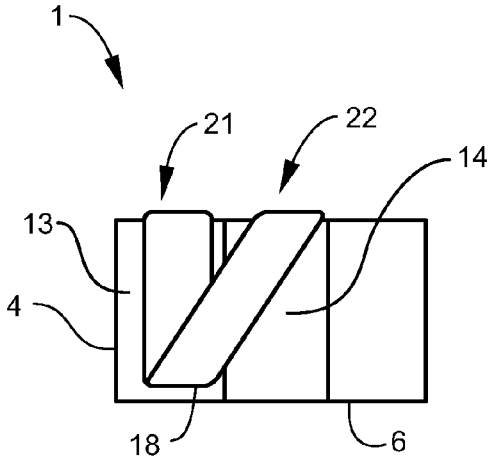
FIG. 12 is a front view of the internal crossover walls of the ammunition magazine showing an ammunition belt crossing over from a first compartment to a second compartment.

Referring now to FIG. 10, the belt 18 is then stacked in overlapping rows in the rear most bay 31 going from the bottom up in a serpentine pattern. When the bay is completely full, the belt is carried forward and dropped down into the bay immediately in front of the filled bay. As seen in FIG. 11, the next bay and the remaining bays 31 are then sequentially filled in the same manner until the belt reaches the crossover bay 17. Referring now to FIG. 12, the belt is draped down to the bottom of the crossover bay 17 and then back up over adjacent crossover wall 14, and down into the forward most bay of compartment 22. Following the sequence of FIGS. 9 through 11, compartment 22 is then filled in the same back to front manner as compartment 21 previously, until the belt again reaches crossover bay 17. From there the belt goes over crossover wall 15 into compartment 23. With compartment 23 completely filled, the belt is brought back to crossover wall 15 where it exits the box through top 7.

Figures 13, 14A:
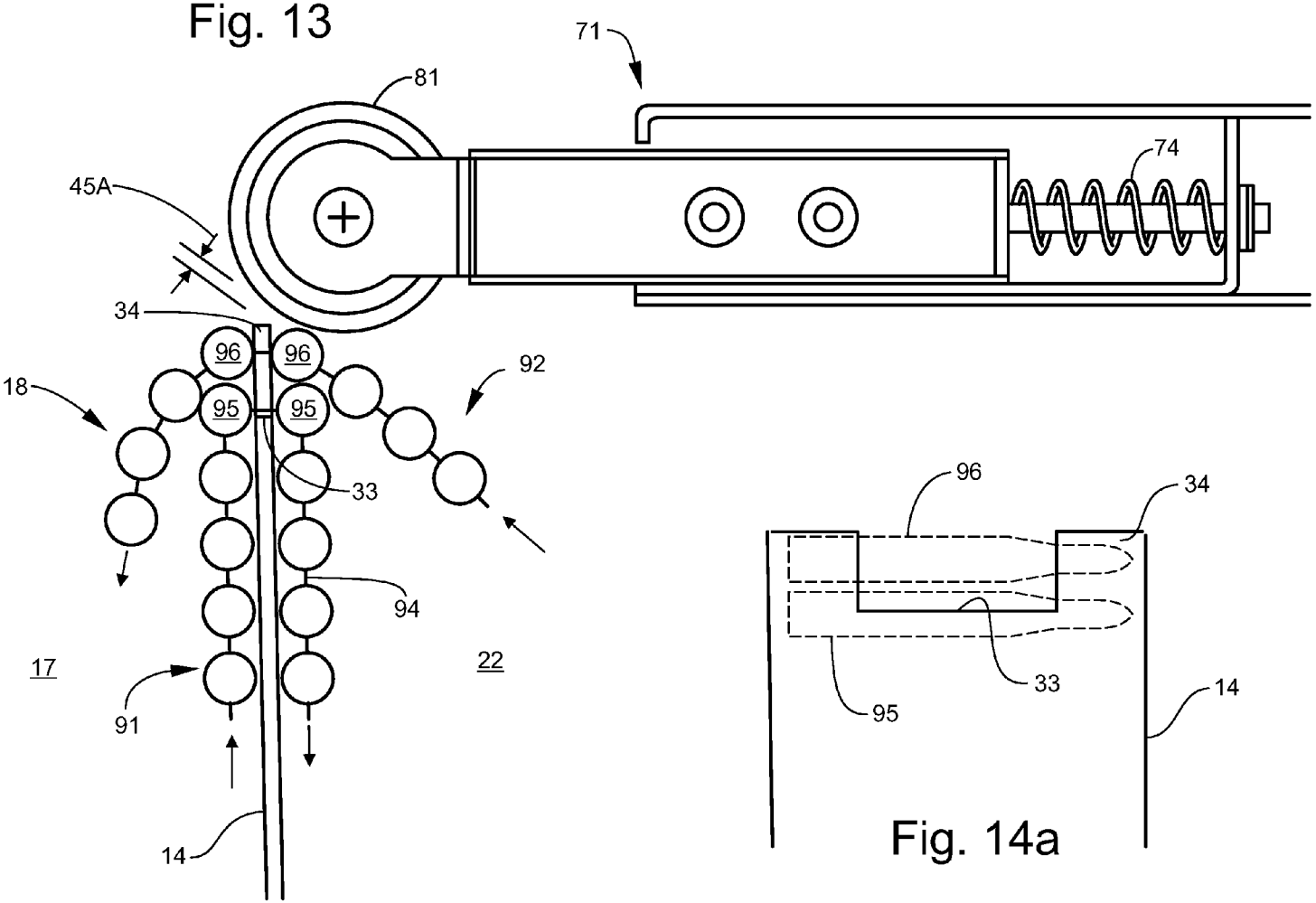
FIG. 13 is a side view of a crossover wall supporting portions of an ammunition belt, and an ammunition lock in the locked position.
FIGS. 14*a* is a plan view of a the crossover wall of FIG. 13 showing the relative positions of two ammunition rounds supported at the top of the wall.

FIG. 13 is a side view depicting portions of an ammunition belt 18 loaded over the middle crossover wall 14 in the manner resulting from the loading sequence of FIGS. 9-12. Specifically, the ammunition belt 18 comprises a first portion 91 going from crossover bay 17, over crossover wall 14, and into compartment 22. This portion of the belt represents the beginning of the loading sequence of the compartment. A second portion 92 of belt 18 overlying the first portion 91 is going in the opposite direction, extending from compartment 22, over crossover wall 14, and into crossover bay 17. This second portion 92 represents the belt leaving a fully loaded compartment 22 following the above described compartment loading sequence. In the case of compartments 21 and 22, the second portion 92 would be looped down into crossover bay 17 and carried over to the next compartment as shown in FIG. 12.

Referring briefly to FIG. 3, each of the crossover walls 13-15 include flange portions 34 at the sides that project above the top edge 33, giving the top of the wall a notched shape. The distance between the flange portions 34 is at least as wide as the belt links 94 that connect the rounds together in the ammunition belt 18. As seen in FIG. 13, the first portion 91 of belt 18 is supported on crossover wall 14 by one of the belt links 94 resting on the top edge 33 of the wall. The second portion 92 of belt 18 is supported by the underlying first portion 91 of the belt, with a belt link 94 also positioned between the flange portions 34.

In order for the ammunition belt 18 to move relative to crossover wall 14 in either direction, the belt must first be above the top of the wall. The reason for this can be seen by referring to FIG. 14*a* which shows the position of the upper most ammunition rounds 95 and 96 of first and second portions 91 and 92 with respect to the top of crossover wall 14. Because the ammunition rounds are longer than the width of the top edge 33 of wall 14, the flange portions 34 act as a barrier between adjacent rounds 95, 96 on either side of wall 14, preventing the belt from moving. Thus from a position straddling the crossover wall as shown in FIGS. 13 and 14*a*, the belt can only move laterally relative to wall 14 by first moving upward until the ammunition rounds clear the tops of the flange portion 34.

Figure 14B:
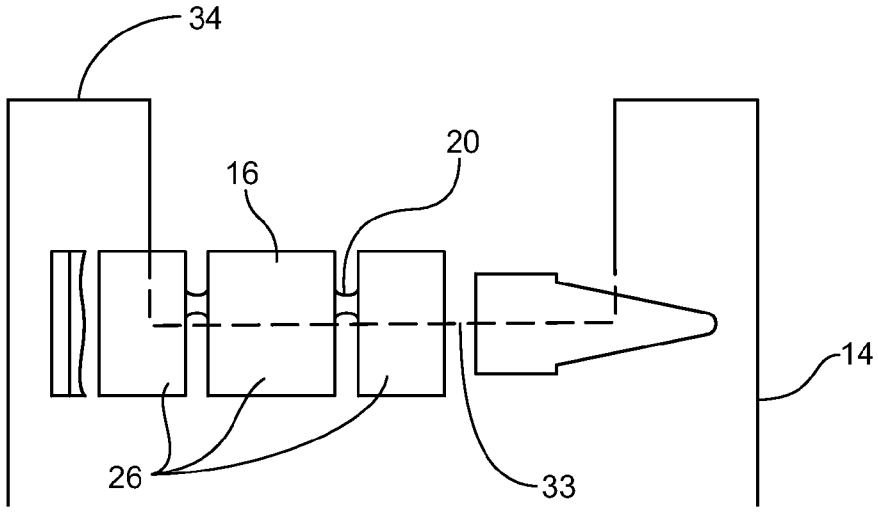
FIGS. 14*b* and 14*c* depict the relative position of the particular ammunition belt of FIG. 1*b* at the top of the crossover wall of FIG. 13.
Figure 14C:
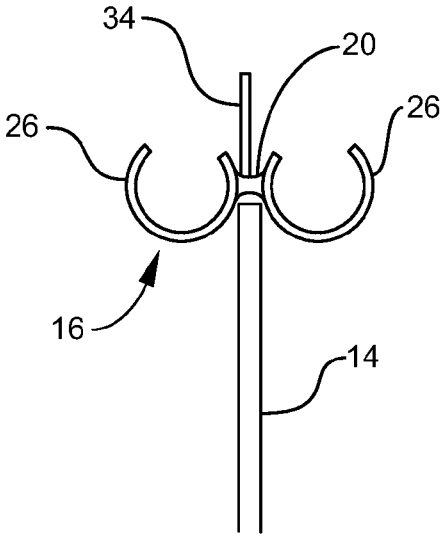

The same concept is illustrated in FIGS. 14*b* and 14*c* for the particular embodiment of a disintegrating link ammunition belt of the type shown in FIGS. 1*b* and 1*c*. Thus, in this embodiment the belt links 94 comprise the metal clips 16, and the ammunition rounds straddle the crossover wall in generally the same manner described above, supported on the wall top 33 by clips 16. In particular, the ammunition belt is supported by the middle portions 20 of clip 16 that extend between the barrel portions 26 that are disposed on either side of the wall. As seen in FIG. 14*b*, a portion of the clip 16 may overlap flange portion 34 of the crossover wall so long as the middle portions 20 fit comfortably between flange portions 34.

Referring again to FIG. 13, an ammunition lock 71 is shown in the extended, locked position wherein the locking end of guided slide member 72, depicted here as locking roller 81, is in close proximity to the top of flange portions 34 of crossover wall 14. The gap 45A between the roller 81 and the top of crossover wall 14 is less than the thickness of the ammunition belt 18, and more specifically less than the diameter of an ammunition round. In one particular embodiment, gap 45A is between one-eighth and one-half the diameter of an ammunition round. As discussed above, for the belt 18 to move laterally across wall 14, the ammunition rounds must be able to pass over the top of flange portions 34. Because gap 45A is less than the diameter of an ammunition round with the slide member 72 in the locked position, the belt is unable to fit through. Under certain operational conditions however, substantial vertically directed inertia loads can be imparted to roller 81 by the ammunition belt, tending to widen gap 45A. To counteract that, the ammunition lock 71 may be sufficiently rigid in the vertical direction to prevent the ammunition belt from squeezing through gap 45A under the maximum anticipated operational acceleration conditions.

Figure 15:
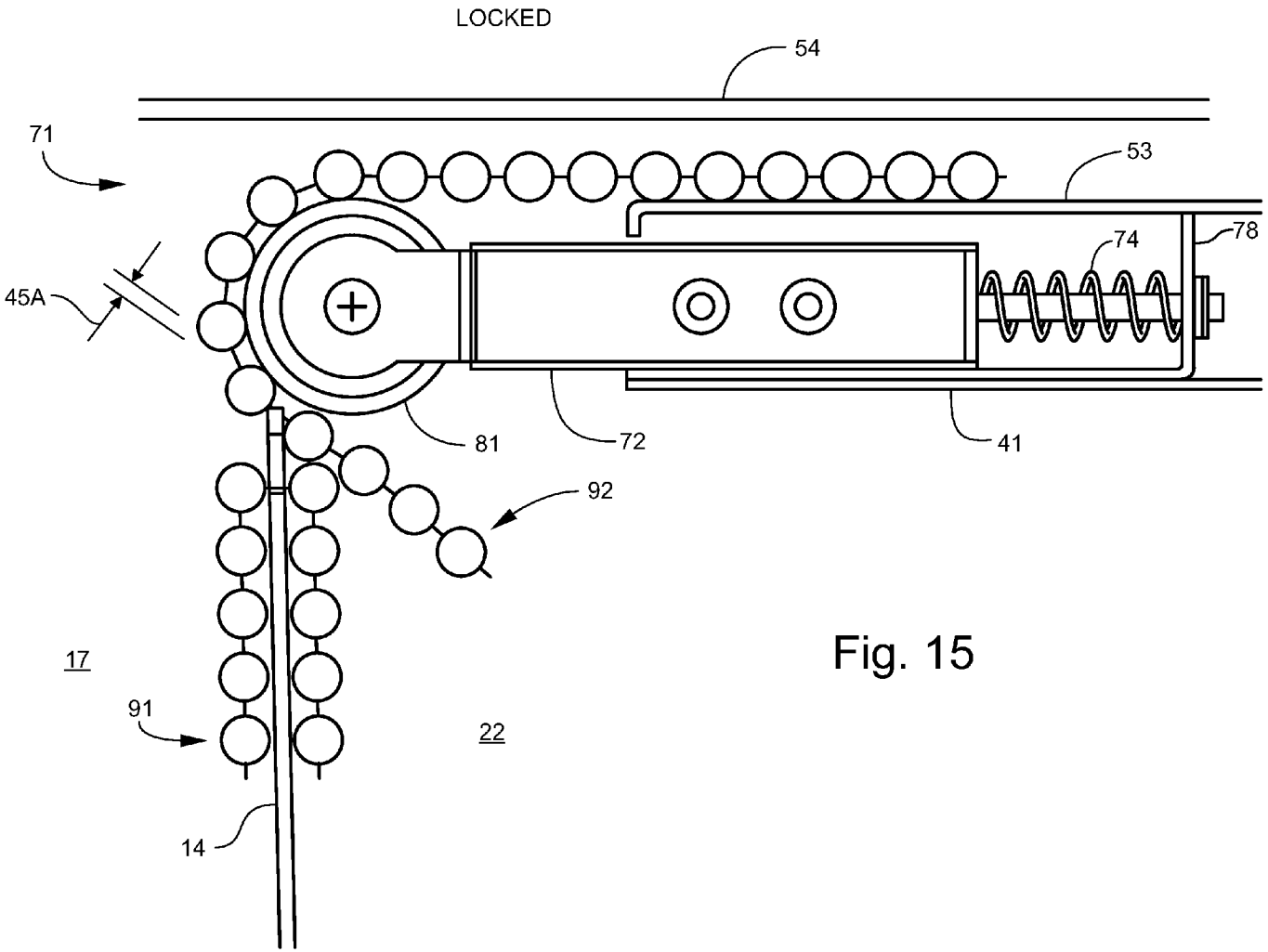
FIG. 15 is another side view of a crossover wall and an ammunition lock in the locked position, with a portion of an ammunition belt going around the ammunition lock and down an ammunition passage.
Figure 16:
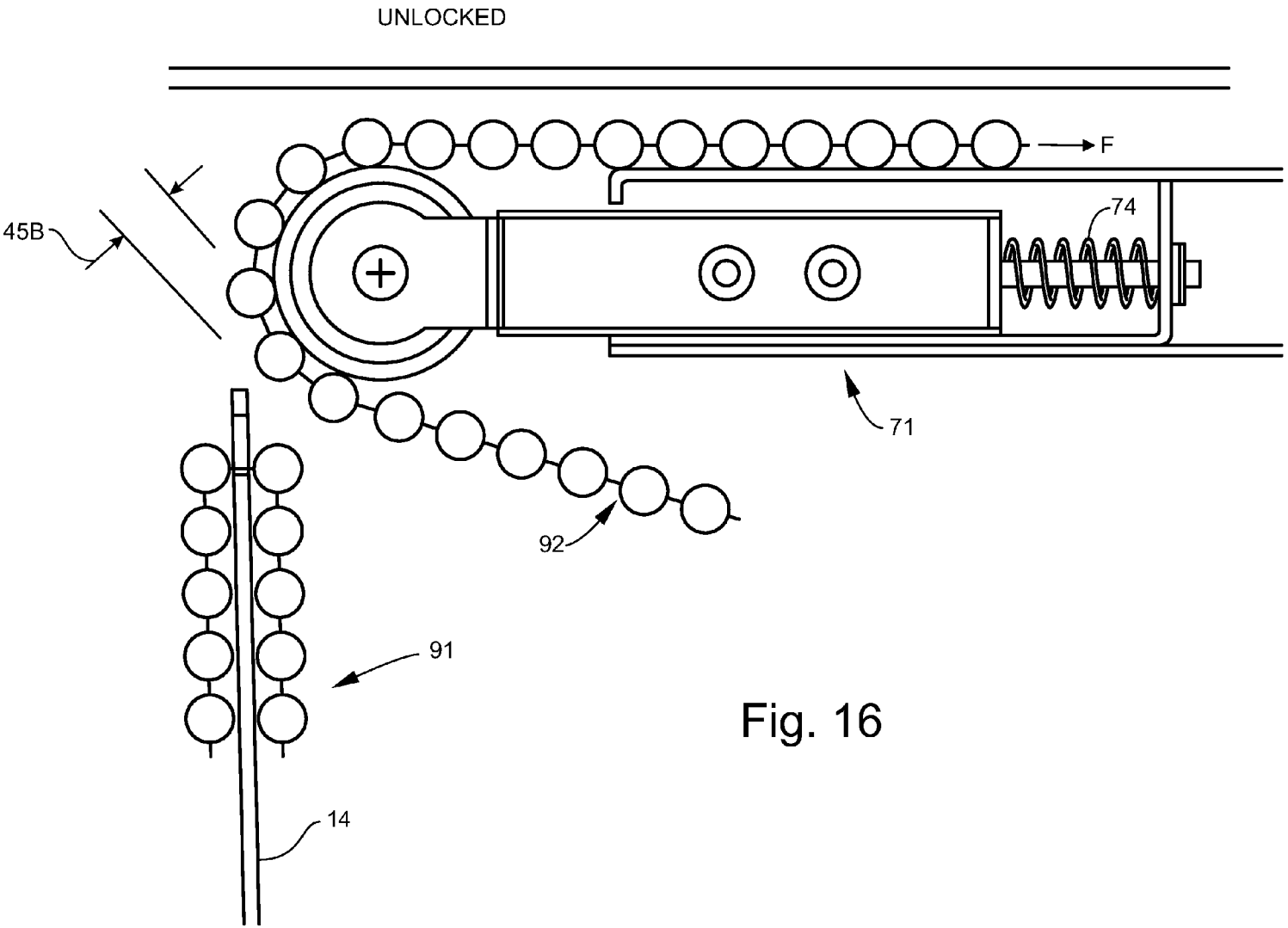
FIG. 16 is the same side view shown in FIG. 15, however with the ammunition lock in the unlocked position.

FIG. 15 is another version of the embodiment of FIG. 13, with ammunition lock 71 again in the extended and locked position relative to the crossover wall 14. However instead of dropping down into crossover bay 17, the second portion 92 of belt 18 in FIG. 15 has been wrapped up around locking roller 81, and extended rearward along chute floor 53 toward exit opening 57. FIG. 16 shows the same view, however with the ammunition lock in the retracted, unlocked position. In the unlocked position, the gap 45B between the locking roller 81 and the top of the crossover wall is greater than the diameter of an ammunition round. The slide member 72 may be moved into the retracted, unlocked position by pulling on the portion of belt 18 extending rearward from roller 81 with a sufficient rearward directed force, as indicated by arrow "F". Further, through proper sizing of springs 74, the lock 71 can be held in the retracted position while the ammunition belt 18 is simultaneously extracted at a steady rate with a continuous, sufficiently large pulling force F. In particular, the lock may be configured so that the force applied to belt 18 by the feed mechanism of an automatic weapon such as gun 8 for example, is more than sufficient to steadily and continuously extract the belt while maintaining the lock 71 in the unlocked position.

Although the ammunition locking feature has been described primarily in terms of a multi-compartment magazine for locking against an internal crossover wall, it is broadly useful with other ammunition magazine constructions as a means to prevent ammunition from moving within, or spilling out of the magazine. For example, an ammunition lock in accordance with the present disclosure may be used to prevent ammunition from spilling from a single compartment magazine with no internal walls. In that case the lock could be adapted to engage any locking surface, such as for example an end wall of the magazine, in fundamentally the same manner described above in reference to the crossover walls.

Operation of the ammunition magazine will now be described. For the sake of convenience the description is given in terms of the three compartment embodiment shown in the drawing figures, although as noted above the ammunition lock is more broadly useful, and not limited to any particular magazine configuration. Accordingly, a magazine 10 is loaded filling all of the compartments according to the sequence of FIGS. 9-12, with the free end of belt 18 extending from the last compartment (23) up around the respective roller 81, down the ammunition passage 58, out through exit opening 57, and to the feed mechanism of a belt feed weapon such as gatling gun 8. As the gun is fired, the gun feed mechanism pulls the ammunition belt 18 at a steady rate with sufficient force to compress and maintain the ammunition lock 71 of compartment 23 in the retracted, unlocked position while the belt is being withdrawn. The ammunition bays 31 of compartment 23 are unloaded front to back, reversing the sequence of FIGS. 9 *through* 12.

When compartment 23 is completely unloaded, the portion of the belt looped down into the crossover bay 17 is pulled out while the belt moves laterally from the roller 81 of compartment 23 to the roller 81 of adjacent compartment 22. The staggered front to back arrangement of the ammunition locks helps the belt slip freely from one roller to the other. No longer restrained by belt tension, the ammunition lock of compartment 23 returns to the locked position, while the belt 18 now holds the ammunition lock 71 of compartment 22 in the retracted, unlocked position. The unloading of compartment 22 proceeds in the same manner as compartment 23 until it is completely empty, when the belt again shifts to the adjacent compartment 21 and continues unloading until the entire box 1 is unloaded and empty.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. An ammunition magazine for storing a continuous belt of linked ammunition rounds and dispensing the ammunition to a belt feed weapon, comprising:

an elongated box comprising an ammunition compartment bounded by walls;

an opening in the box for dispensing the belt of linked ammunition; and an ammunition lock proximate the opening comprising a guided slide member with a locking end, the guided slide member adapted for longitudinal sliding movement between locked and unlocked positions in a direction substantially perpendicular to the plane of an ammunition compartment wall, wherein in the locked position the distance between the locking end of the ammunition lock and a top of the ammunition compartment wall is less than the thickness of the ammunition belt, and in the unlocked position the distance between the locking end of the ammunition lock and the ammunition compartment wall is greater than the thickness of the ammunition belt; and a spring configured to bias the guided slide member from the unlocked position to the locked position.

2. The ammunition magazine of claim 1, wherein the locking end is a cylindrical roller journaled for rotation about an axis substantially parallel with the top of the ammunition compartment wall.

3. The ammunition magazine of claim 2, wherein the ammunition compartment wall is a first crossover wall dividing the elongated box into a first ammunition compartment extending from the crossover wall to a back wall of the ammunition magazine, and a crossover bay between the crossover wall and a front wall of the ammunition magazine, and wherein the ammunition lock is positioned above the ammunition compartment, and slides forward, toward the crossover wall to the locked position.

4. The ammunition magazine of claim 3 further comprising:

a first longitudinal partition dividing the elongated box into adjacent first and second ammunition compartments extending from a back wall of the box at one end to respective first and second crossover walls at the other end; and a second ammunition lock associated with the second ammunition compartment.

5. The ammunition magazine of claim 4, further comprising a feeder chute atop a lid, the feeder chute comprising a chute top, a chute floor, and opposed chute sidewalls, wherein the ammunition locks are mounted between the lid and the chute floor, and the opening is in the lid.

6. The ammunition magazine of claim 4, further comprising a second longitudinal partition dividing the box further into adjacent first, second, and third compartments extending from the back wall at one end to respective first, second, and third crossover walls at the other end.

7. The ammunition magazine of claim 6, further comprising baffles subdividing the ammunition compartments into ammunition bays.

8. The ammunition magazine of claim 4, wherein the top of each of the crossover walls comprises flange portions at the sides of the crossover wall projecting above a top edge between the flange portions, creating a notched shape.

9. The ammunition magazine of claim 8, wherein the distance between the locking end of the ammunition lock and the top of the flange portions is less than the thickness of the ammunition belt when the ammunition lock is in the locked position, and greater than the thickness of the ammunition belt when the ammunition lock is in the unlocked position.

* * * * *